United States Patent [19]

Henkenjohann

[11] 4,365,660

[45] Dec. 28, 1982

[54] ROLLER BLIND

[75] Inventor: Johann-Georg Henkenjohann, Verl, Fed. Rep. of Germany

[73] Assignee: Johann Henkenjohann, Fed. Rep. of Germany

[21] Appl. No.: 263,141

[22] Filed: May 13, 1981

[30] Foreign Application Priority Data

May 22, 1980 [DE] Fed. Rep. of Germany ..... 3019566

[51] Int. Cl.[3] ..... E06B 9/08

[52] U.S. Cl. ..... 160/133; 160/220

[58] Field of Search ..... 160/133, 232, 235, 220, 160/193, 202; 49/322; 292/38, 166, 167, 171, 225, 235

[56] References Cited

U.S. PATENT DOCUMENTS

| | | | |
|---|---|---|---|
| 922,889 | 5/1909 | Hannemann | 292/167 |
| 1,490,777 | 4/1924 | Fortune | 292/166 |
| 1,707,287 | 4/1929 | Sudzki | 160/232 |
| 1,883,027 | 10/1932 | Smith | 292/171 |
| 1,994,142 | 3/1935 | Madsen | 160/193 |
| 2,064,470 | 12/1936 | Heckman | 292/171 |
| 2,191,437 | 2/1940 | Bode | 292/171 |
| 4,035,008 | 7/1977 | Hardt | 160/220 |
| 4,080,757 | 3/1978 | Westerman | 292/171 |

FOREIGN PATENT DOCUMENTS

| | | | |
|---|---|---|---|
| 353794 | 5/1922 | Fed. Rep. of Germany | 49/322 |
| 2725576 | 12/1978 | Fed. Rep. of Germany | 160/133 |
| 2745560 | 4/1979 | Fed. Rep. of Germany | 160/133 |
| 1506938 | 11/1967 | France | 292/171 |

*Primary Examiner*—Peter M. Caun

*Attorney, Agent, or Firm*—Bacon & Thomas

[57] ABSTRACT

A roller blind for closing openings in buildings, such as windows, doors, or the like, which blind is formed from a plurality of laminated strips which are attached one to the other and whose ends are guided in guide rails, and has an insertable bolt for locking the roller blind and which is provided in the lowermost laminated strip. This lowermost strip is formed as an end bar housing said bolt which can penetrate into an opening in one of the guide rails in the closed (locked) position under the action of a spring. For unlocking purposes, a cord which is secured to the bolt, is guided upwards through endpieces of the laminated strips and secured so that, upon winding the laminated strips around the winding shaft, the bolt is withdrawn from the opening in the guide rail against the action of the spring.

8 Claims, 7 Drawing Figures

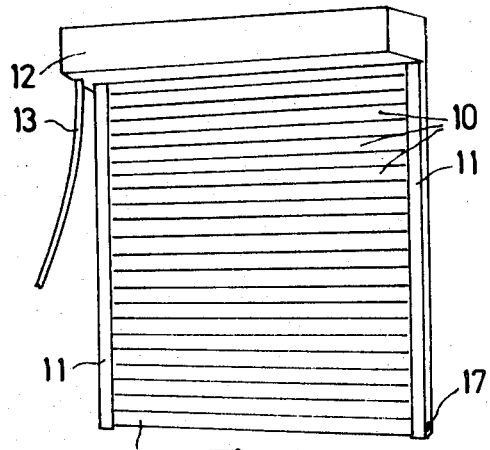
Fig. 1
Fig. 3
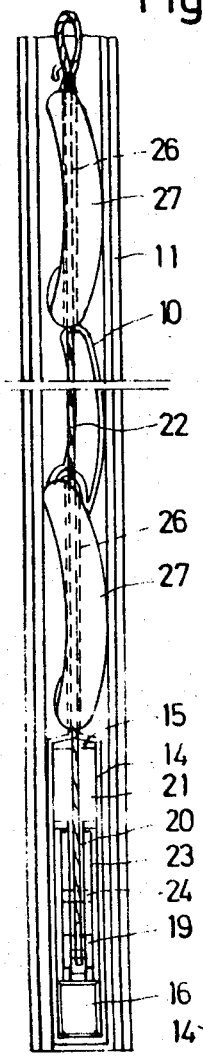
Fig. 2
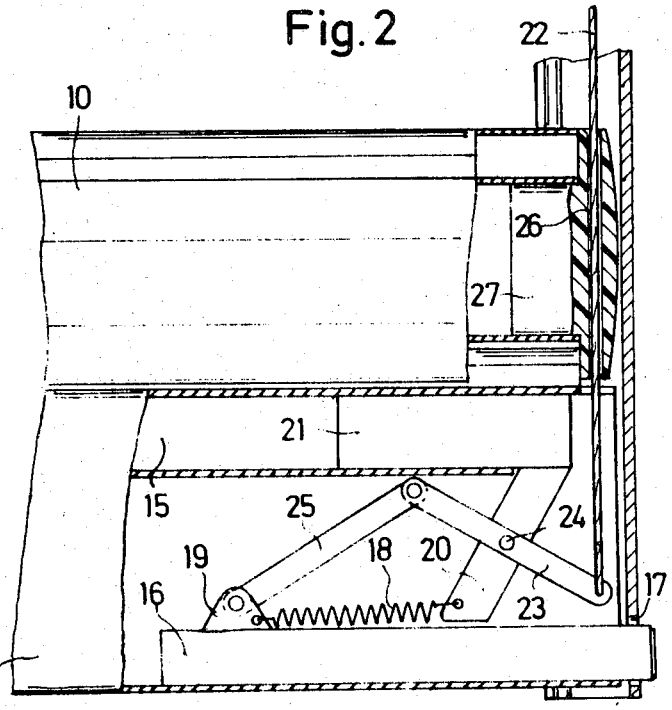

ROLLER BLIND

The present invention relates to a roller blind having a plurality of laminated strips, which are attached one to the other and are guided at their lateral ends in two guide rails, and having a locking mechanism, the end bar acting as the lowermost laminated strip and comprising a bolt which is insertable into an opening in a guide rail.

The object of the invention is to increase security against break-ins in the case of buildings which are locked with roller blinds. As a result of its automatically operating locking mechanism, it should be impossible to raise the laminated strips of a roller blind in the lowered position directly, for example, manually. In this case, the locking mechanism should have a positive mode of operation and the simplest possible construction.

According to the invention there is provided a roller blind comprising a plurality of laminated strips which strips are attached to one another and are guided at their lateral ends in two guide rails, a locking mechanism, and an end bar forming the lowermost of the laminated strips and including a bolt which is insertable into an opening in one of the guide rails, wherein the locking mechanism comprises a spring which causes the bolt to move into a closed, locked position, and a cord, which enables the bolt to be moved into an open, unlocked position.

The rope is preferably disposed inside the guide rail which is provided with the opening, the lower end of the rope being connected to the bolt, whilst its upper end is secured to the uppermost laminated strip.

The claims contain preferred embodiments of the invention. The scope of protection extends not only to the individual features claimed but also to a combination thereof.

The invention will be described further, by way of example, with reference to the accompanying drawings, in which:

FIG. 1 is a front view of a closed roller blind having a roller blind box.

FIG. 2 shows one embodiment of the locking mechanism in the bottom right-hand region of the roller blind.

FIG. 3 is a lateral view of the roller blind having the locking mechanism shown in FIG. 2;

Figure 5:
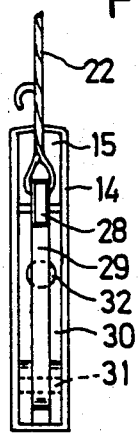
FIG. 5 is a lateral view of the locking mechanism shown in FIG. 4.

The roller blind according to the invention comprises a plurality of laminated strips 10 of identical design, which are attached one to the other, and whose ends are guided in guide rails 11 on both sides of the door or window opening. The roller blind can be rolled up onto a winding shaft which is disposed in a roller blind box 12 and is operated, for example, by means of a cord 13. The laminated strips 10 are designed as hollow bodies and may be filled with a foamed plastics material. The lowermost laminated strip is designed as an end bar 14 having a cavity, from which is separated a channel 15.

According to FIGS. 2 and 3 of the drawing, a bolt 16, which is displaceable in the horizontal direction, is disposed inside the cavity of the end bar 14 at the lower end and, in the open position of the roller blind, is located entirely within the bar end 14. In the closed position, however, one end of the bolt 16 projects into an opening 17 in the adjacent guide rail 11. If any attempt were made to raise the roller blind from the closed position, then the bolt 16 would be held fast at the opening 17, thus preventing the roller blind from being raised.

A spring 18, which is a cylindrical spiral tension spring, ensures the displacement of the bolt 16 into the opening 17. One end of this spring 18 is connected to an arm 19 which is secured to the bolt 16. The other end of the spring 18 is connected to an arm 20 which is secured to an insert member 21 which is inserted firmly into the channel 15 of the end bar 14. A cord 22, which is disposed inside the guide rail 11, enables the bolt 16 to be withdrawn from the opening 17 against the action of the spring 18. The lower end of the cord 22 is secured to a swivel lever 23 which is pivotably mounted on the arm 20 by way of a pivot pin 24. The end of the swivel lever 23 remote from the cord 22 is articulated with a further swivel lever 25 which, in turn, is articulated with the arm 19 of the bolt 16.

The cord 22 is guided inside the guide rail 11 through bores 26 in a plurality of endpieces 27 which are inserted laterally into the laminated strips 10 and close these. At its upper end, the cord 22 is secured to the uppermost laminated strip 10 and is raised or lowered respectively therewith. When the roller blind is raised, the cord 22 also raises the swivel lever 23 at its lower end, so that the swivel lever 23 pivots about its pivot pin 24 and, by way of the swivel lever 25, draws the bolt 16 into the cavity of the end bar 14 against the action of the spring 18. The bolt 16 thereby clears the opening 17 in the guide rail 11, so that the roller blind is unlocked and the end bar 14 can then also be raised.

The length of the cord 22 is arranged so that, after the roller blind has been lowered, the swivel lever 23 may adopt the position shown in FIG. 2 as a result of the action of the spring 18, so that the bolt 16 is moved by the spring 18 into the opening 17 and the locking of the roller blind is accomplished.

Figure 4:
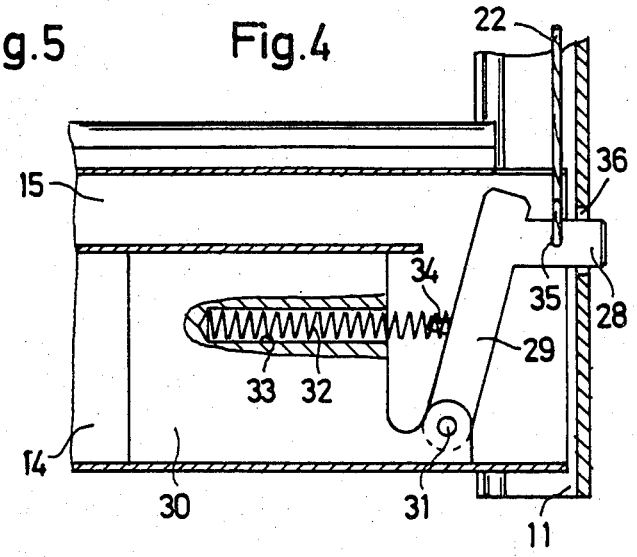
FIG. 4 shows a further embodiment of the locking mechanism in the bottom right-hand region of a roller blind.

According to FIGS. 4 and 5 of the drawing, the bolt 28 is secured to the upper end of a swivel lever 29 and is constructed, for example, so as to be integrally connected thereto. The swivel lever 29 is mounted on an insert member 30, which is firmly inserted into the cavity of the end bar 14, by way of a pivot 31. The spring 32, which effects the locking, is in this case designed as a cylindrical spiral compression spring, one end of which is supported inside a bore 33 in the insert member 30 and the other end of which is supported on a pin 34 of the swivel lever 29. At its lower end, the cord 22 engages directly with the bolt 28, the cord 22 being guided through a bore 35 in the bolt 28 and being secured thereto. In this embodiment, the bolt 28 does not move in an exact straight line, but an arc of a circle with the pivot 31, as its centre. After the lowering of the end bar 14, the cord 22 moves downwards during the lowering of the roller blind, so that no more tension acts upwardly on the bolt 28. The bolt 28 can then be urged into the opening 36 in the guide rail 11 by the spring 32 engaging with the swivel lever 29, and locking may be accomplished in this manner. During the raising of the roller blind, the cord 22 first of all causes the bolt 28 to swivel out of the opening 36 and into the cavity of the end bar 14 against the action of the spring 32. The locking mechanism is thereby released and the end bar 14 may now also be raised.

Figure 7:
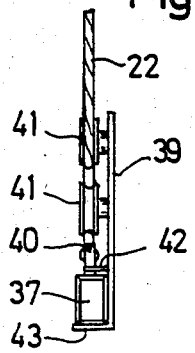
FIG. 7 is a lateral view of the locking mechanism shown in FIG. 6.
Figure 6:
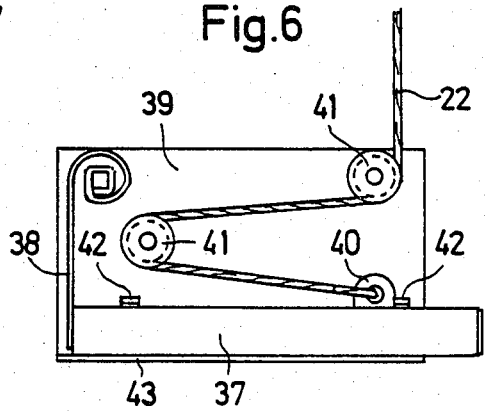
FIG. 6 shows a third embodiment of the locking mechanism.

According to FIGS. 6 and 7, the bolt 37 is acted upon by a spring 38, which is designed as a leaf spring and is secured at one end to a bracket 39. The cord 22 is secured to a lug 40 secured to the bolt 37. So as to be able to displace the bolt 37 against the action of the spring 38, the cord 22 in this embodiment is guided by way of two guide rollers 41 mounted on the bracket 39. The bracket 39 comprises an angled arm 43 and arms 42 for the guidance of the bolt 37.

In this embodiment, a tension spring 18, as in FIG. 2, may be used instead of the leaf spring 38, one end of this tension spring 18 being secured to the bracket 39 and the other end of this tension spring 18 being secured to the bolt 37. Further, a compression spring 32 as shown in FIG. 4 may alternatively be used, the bracket 39 comprising a stop, which is bent downwards in the locking direction, on the counter-bearing and a bore for accommodating the compression spring 32 having to be provided in the bolt 37.

I claim:

1. A roller blind comprising: a plurality of hollow laminated strips, which strips are attached to one another and are guided at their lateral ends in two guide rails; end pieces inserted into at least one of the ends of each of the hollow, laminated strips so as to close off the end, each end piece defining a vertical bore therethrough such that the bores are aligned when the strips are attached to one another; a locking mechanism located in an end bar acting as the lowermost laminated strip having a bolt movable between a retracted, unlocked position and an extended, locked position wherein it engages an opening in one of the guide rails; spring means biasing the bolt into its extended, locked position; and a cord extending through the end piece bores which causes the bolt to move into its retracted, unlocked position.

2. The roller blind of claim 1 wherein the cord is located within the guide rail having an opening for engagement with the bolt, the upper end of the cord is secured to the uppermost laminated strip and the lower end of the cord is connected to the bolt.

3. A roller blind according to claim 1, wherein the spring is a cylindrical spiral tension spring, one end of the spring being secured to an arm provided on the bolt and the other end of the spring being secured to an arm of an insert member which is firmly inserted into a channel provided in the lower end bar and which is separated from a cavity also provided in the lower end bar.

4. A roller blind according to claim 3, wherein the lower end of the cord is secured to one end of a swivel lever which is flexibly mounted on the arm of the insert member, the other end of said swivel lever being flexibly connected to the arm of the bolt by way of a further swivel lever.

5. A roller blind according to claim 1, wherein the spring is designed as a cylindrical spiral compression spring, one end of which spring is supported inside a bore in an insert member, which is firmly inserted into a cavity provided in the end bar, and the other end of which spring is supported on a swivel lever, which is articulated with the insert member and is designed so as to be integrally connected to the bolt.

6. A roller blind according to claim 1 wherein the spring is designed as a leaf compression spring and is secured, with a spiral-shaped end, to a bracket which contains a guide path for the bolt and is firmly inserted into a cavity provided in the end bar.

7. A roller blind according to either of claims 6 or 1, wherein the lower end of the cord is guided through a bore in the bolt and is secured therein.

8. A roller blind according to either of claims 6 or 1, wherein the lower end of the cord is guided on two guide rollers which are mounted on the bracket and is secured to a lug which is located on the bolt.

* * * * *